US005431993A

United States Patent [19]

Metzler

[11] Patent Number: 5,431,993

[45] Date of Patent: Jul. 11, 1995

[54] REINFORCED SLEEVE FOR A PAPER MACHINE

[75] Inventor: Steven P. Metzler, Covington, Va.

[73] Assignee: Westvaco Corporation, New York, N.Y.

[21] Appl. No.: 258,457

[22] Filed: Jun. 10, 1994

[51] Int. Cl.[6] ..... B32B 9/00

[52] U.S. Cl. ..... 428/224; 428/76; 428/105; 428/107; 428/109; 428/221; 428/229; 428/284; 162/202; 162/901; 162/900; 162/358.1; 162/358.3

[58] Field of Search ..... 428/229, 257, 258, 259, 428/224, 225, 33, 102, 193, 105, 107, 284, 222, 76, 109, 221, 121; 162/202, 358

[56] References Cited

U.S. PATENT DOCUMENTS

| | | | |
|---|---|---|---|
| 4,483,745 | 11/1984 | Wicks et al. | 162/205 |
| 4,518,460 | 5/1985 | Hauser et al. | 162/361 |
| 4,695,438 | 9/1987 | Sarrazin et al. | 428/121 |
| 4,755,420 | 7/1988 | Baker et al. | 428/222 |
| 4,970,100 | 11/1990 | Vöhringer | 428/105 |
| 5,178,732 | 1/1993 | Steiner et al. | 162/360.2 |
| 5,240,563 | 8/1993 | Karvinen et al. | 162/274 |
| 5,240,763 | 8/1993 | Wagner et al. | 428/222 |

FOREIGN PATENT DOCUMENTS 1155972 10/1963 Germany .

*Primary Examiner*—Patrick J. Ryan
*Assistant Examiner*—Abraham Bahta
*Attorney, Agent, or Firm*—J. R. McDaniel; R. L. Schmalz

[57] ABSTRACT

This invention relates to sleeves or belts which are used in paper machines. Such structures of this type, generally, are reinforced through the use of reinforcing fibers which are oriented at an angle turned 45° from the straight machine direction orientation. This arrangement aligns the individual reinforcing strands in the direction of the principal tensile stresses that exist within the sleeve or belt structure as the sleeve or belt is being rotated in the paper machine.

2 Claims, 1 Drawing Sheet

REINFORCED SLEEVE FOR A PAPER MACHINE

BACKGROUND OF THE INVENTION

1. Field of the Invention

This invention relates to sleeves or belts which are used in paper machines. Such structures of this type, generally, are reinforced through the use of reinforcing fibers which are oriented at an angle turned 45° from the straight machine direction orientation. This arrangement aligns the individual reinforcing strands in the direction of the principal tensile stresses that exist within the sleeve or belt structure as the sleeve or belt is being rotated in the paper machine.

2. Description of the Related Art

Modern "extended nip" or "shoe-type" wet presses used in paper machines generate nip loads on the order of 6000 pounds per linear inch of machine width. These high nip loadings will destroy the belt that forms one side of the nip on a Beloit Extended Nip ® press, or the flexible sleeve that forms one side of the nip on a Voith FlexoNip ® press, Sulzer Escher Wyss Intensa ® press, or Valmet SymPress ® press, if the belt or sleeve enters the nip in a folded or buckled state. Any deformation of the belt or sleeve that reveals local stress and strain necessitates the immediate replacement of the belt or sleeve.

Belts and sleeves, typically, are constructed of urethane or polyurethane material that encases a reinforcement of polyester, Nylon and/or Kevlar ® fibers. The reinforcing fibers may be in the form of woven fabrics or may appear as individual strands of multiple fibers. Individual filaments within a fabric or strand are oriented either parallel to the direction of travel or perpendicular to the direction of travel in the plane of the sleeve surface. These are commonly referred to as machine direction (MD) or the cross machine direction (CMD) on the paper machine, respectively.

The purpose of the fabric reinforcement is to increase the strength of the cover to help it to resist forces that cause local bulging and buckling. While these individual filaments provide support in either the MD or CMD direction, these filaments do not address the problems associated with tensile stresses that are often encountered by the sleeves. Therefore, a more advantageous sleeve or belt would be one that was able to provide the proper strength for the sleeve or belt while at the same time resisting the tensile stresses located within the sleeve or belt.

It is also known, in paper making machines, to employ the use of a wet press felt constructed of a rhombic mesh. Exemplary of such prior art is German Patent No. 1,155,972 to Eduard Kusters. While the Kusters patent teaches the use of a rhombic mesh, the rhombic mesh is used to improve the removal of the water from the paper as the paper is formed upon the press felt. The rhombic mesh more easily allows the water to drain from the paper and the press felt. However, the rhombic nature of the press felt is not utilized to strengthen the press felt. Therefore, a still further advantageous sleeve or belt would be one which utilized a filament orientation which resisted the tensile stresses within the sleeve or belt structure while at the same time providing adequate strength for the sleeve or belt.

It is apparent from the above that there exists a need in the art for a sleeve or belt which is capable of being used in a paper machine, and which at least equals the strength characteristics of the known sleeves or belts, but which at the same time is able to reduce the deformations that occur in response to the tensile stresses within the sleeve or belt and which cause the sleeve or belt to buckle and/or bulge. It is the purpose of this invention to fulfil this and other needs in the art in a manner more apparent to a skilled artisan once given the following disclosure.

SUMMARY OF THE INVENTION

Generally speaking, this invention fulfills these needs by providing a cover for a press shoe roll, comprising a flexible cover located substantially on said roll such that said flexible cover is retained on said roll in a first direction, and a plurality of filaments located substantially within said flexible cover such that said plurality of filaments are located within said flexible cover at an angle with respect to said first direction of said flexible cover in order to reduce torsional deformations within said flexible cover.

In certain preferred embodiments the flexible cover is a sleeve or belt. Also, the flexible cover is located on the press shoe roll around the circumference of the press shoe roll. Finally, the angle is approximately 45°.

In another further preferred embodiment, the filaments are located at an angle of approximately 45° with respect to the direction of the flexible cover in order to align these filaments in the direction of tensile stresses that exist within the flexible cover structure as the flexible cover is being rotated.

The preferred cover, according to this invention, offers the following advantages: lightness in weight; flexibility; high strength for safety; reduced torsional deformations; good stability; good durability; and good economy. In fact, in many of the preferred embodiments, these factors of flexibility, strength and tensile stress reduction are optimized to an extent that is considerably higher than heretofore achieved in prior, known covers for paper machines.

The above and other features of the present invention, which will become more apparent as the description proceeds, are best understood by considering the following detailed description in conjunction with the accompanying drawings, wherein like characters represent like parts throughout the several views and in which:

BRIEF DESCRIPTION OF THE DRAWINGS

FIG. 3*a* represents the element in a state of pure shear, and FIG. 3*b* represents the same element transformed to a state of tension and compression.

DETAILED DESCRIPTION OF THE INVENTION

Figure 1:
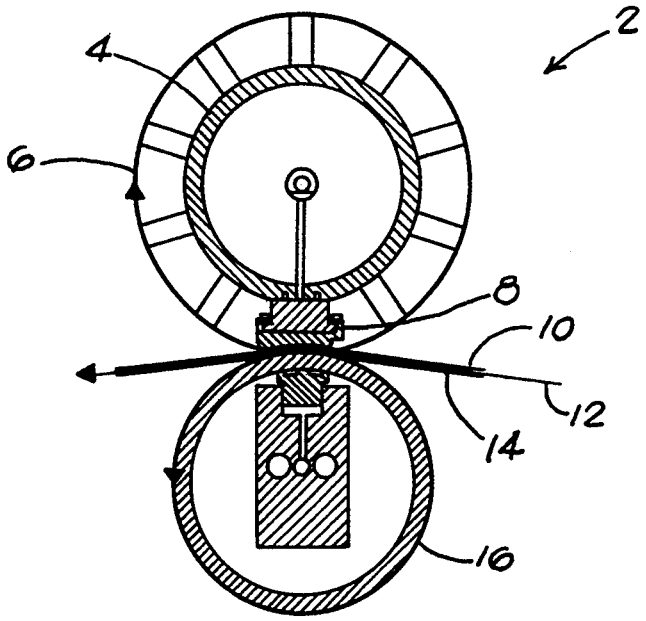
FIG. 1 is a schematic illustration of a shoe-type wet press having a flexible sleeve or belt, according to the present invention.

With reference first to FIG. 1, there is illustrated shoe-type wet press 2. Press 2 includes in part, press shoe roll 4, sleeve or belt 6, loading shoe 8, conventional top felt 10, conventional paper web 12, conventional bottom felt 14, and counter roll 16. It is to be understood that while shoe-type wet press 2 is shown, the sleeve or belt 6 could be applied to an extended nip type wet press, too.

Figure 2:
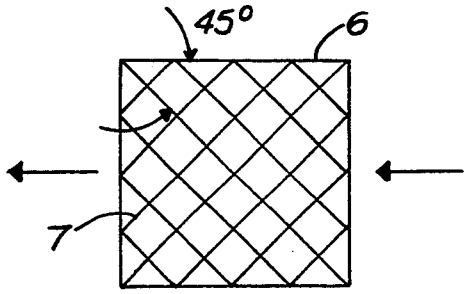
FIG. 2 is a schematic illustration of the sleeve or belt, according to the present invention.

With respect to FIG. 2, sleeve or belt 6 is illustrated. While sleeve or belt 6 is, typically, wound around the circumference of press shoe roll 4, the location of reinforcement filament 7 is such that the filaments are located at an angle of approximately 45° from the direction of rotation of sleeve or belt around the circumference of the shoe roll 4. Filaments 7 are located at this particular angle because localized stresses can occur within belt or sleeve 6 due to cross machine non-uniformity in: 1.) the loading shoe 8; 2.) the diameter of counter roll 16; 3.) the thickness of the press felts 10 and 14; 4.) the thickness of the belt or sleeve 6; 5.) the thicknesses of paper web 12; and 6.) the nip loading itself. Any of the above can cause cross machine variations in nip "speed" which, in turn, necessitates localized slip to occur between the sleeve or belt 6, the felts 10 and 14, paper web 12, and counter roll 16. Because of the high pressure within the nip, frictional forces induced by the slip are great. The frictional forces that act upon the sleeve or belt 6 induce shearing stresses. In this manner, the sleeve or belt 6 can be visualized as a flexible coupling forced to transmit torque.

Figure 3A:
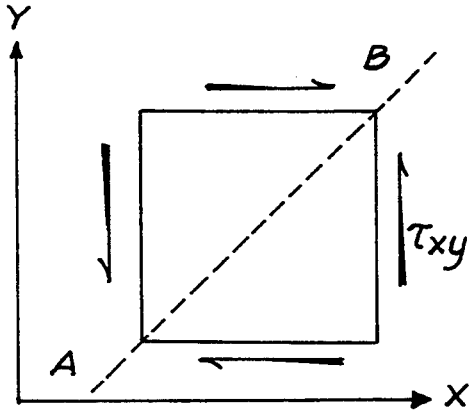
FIGS. 3*a* and 3*b* are schematic illustrations which show two equivalent descriptions of a stressed element, where
Figure 3B:
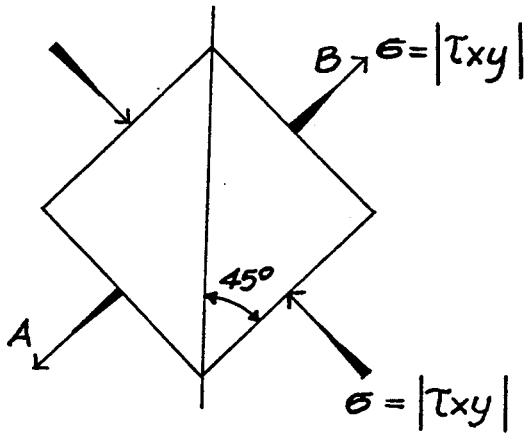

The resulting state of stress within the belt or sleeve 6 is shown in FIG. 3A, which shows an element subjected to pure shear. The same state of stress is identically described in FIG. 3B, which shows an element subjected to tensile and compressive stresses, each of which are equal in magnitude to the original shearing stresses, but oriented at a 45° angle. In this manner, the sleeve or belt 6 is oriented around the circumference of press shoe roll 4 such that sleeve or belt 6 is forced to transmit torque. As sleeve or belt 6 is transmitting torque, the reinforcing filaments 7 are aligned along the 45° angle in the direction of the positive shear diagonal which is parallel to the maximum tensile stresses. Consequently, the orientation of the filaments 7, as set forth in the present invention, not only provides excellent strength to the sleeve or belt 6 but also substantially reduces the maximum torsional deformations within the sleeve or belt 6.

Once given the above disclosure, many other features, modifications or improvements will become apparent to the skilled artisan such features, modifications or improvements, are therefore, considered to be a part of this invention, the scope of which is to be determined by the following claims.

What is claimed is:

1. A cover for a press shoe roll, wherein said cover is comprised of:

a flexible cover located entirely around a circumference of said roll; and a plurality of filaments located substantially within said flexible cover such that said plurality of filaments are located within said flexible cover at an angle with respect to said first direction of said flexible cover in order to reduce torsional deformations within said flexible cover wherein said angle is approximately 45°.

2. A cover for an extended nip roll, wherein said cover is comprised of:

a flexible cover located entirely around a circumference of said roll; and a plurality of filaments located substantially within said flexible cover such that said plurality of filaments are located within said flexible cover at an angle with respect to said first direction of said flexible cover in order to reduce torsional deformations within said flexible cover wherein said angle is approximately 45°.

* * * * *